US007319376B2

(12) United States Patent
Kobayashi et al.

(10) Patent No.: US 7,319,376 B2
(45) Date of Patent: Jan. 15, 2008

(54) NOISE FILTER

(75) Inventors: Katsumi Kobayashi, Tokyo (JP); Masaru Yaguchi, Tokyo (JP); Setu Tuchida, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/598,797

(22) Filed: Nov. 14, 2006

(65) Prior Publication Data

US 2007/0120635 A1 May 31, 2007

(30) Foreign Application Priority Data

Nov. 29, 2005 (JP) ..... 2005-343832

(51) Int. Cl.
*H01F 17/06* (2006.01)

(52) U.S. Cl. ..... 336/175

(58) Field of Classification Search ..... 336/65, 336/90, 92, 173–175; 333/181
See application file for complete search history.

(56) References Cited

U.S. PATENT DOCUMENTS

| | | | | |
|---|---|---|---|---|
| 5,355,109 | A * | 10/1994 | Yamazaki | 336/92 |
| 5,942,964 | A * | 8/1999 | Takeuchi | 336/92 |
| 6,335,672 | B1 * | 1/2002 | Tumlin et al. | 336/175 |

FOREIGN PATENT DOCUMENTS

| | | | |
|---|---|---|---|
| JP | U-63-39997 | | 3/1988 |
| JP | U-2-110398 | | 9/1990 |
| JP | 03-181106 | A | 8/1991 |
| JP | A-3-268397 | | 11/1991 |
| JP | A-7-273485 | | 10/1995 |
| JP | 08-153627 | * | 6/1996 |
| JP | A-9-7839 | | 1/1997 |
| JP | A-9-22821 | | 1/1997 |
| JP | 10-284870 | A | 10/1998 |
| JP | A-10-322079 | | 12/1998 |
| JP | A-10-335147 | | 12/1998 |
| JP | A-11-150389 | | 6/1999 |
| JP | A-11-204982 | | 7/1999 |
| JP | A-2000-91136 | | 3/2000 |
| JP | 2000-286129 | A | 10/2000 |
| JP | 2001-326123 | A | 11/2001 |
| JP | 2002-299125 | * | 10/2002 |

* cited by examiner

*Primary Examiner*—Tuyen T. Nguyen
(74) *Attorney, Agent, or Firm*—Oliff & Berridge, PLC

(57) ABSTRACT

An impact and vibration-resistant noise filter avoiding cracking of a core at the time of application of a vibration or impact. The noise filter includes a case and core. The case has a first case portion having a first wall portion, a second wall portion, and a first bottom wall portion. The first and second wall portions have first and second parting surfaces, respectively on the end surfaces thereof. The first bottom wall portion is positioned between the first and second wall portions. A first supporting piece 31B, whose base end is positioned on the side of the first bottom wall portion and whose free end extends toward the first parting surface, is formed on the first wall portion. Similarly, a second supporting piece is formed in the second wall portion. First and second presser pieces are formed respectively on the first and second bottom wall portions. The core is resiliently retained by the first and second supporting pieces, and first and the second presser pieces.

10 Claims, 6 Drawing Sheets

NOISE FILTER

BACKGROUND OF THE INVENTION

The present invention relates to a noise filter, and more particularly, to a noise filter attached to a power cable.

Conventionally, in an electronic apparatus, a noise filter provided with a ferrite core has been attached to a power cable in order to remove noise generated from a power supply. Specifically, the power cable is inserted through a through hole formed in the ferrite core to fix the position of the ferrite core relative to the power cable, and the ferrite core is surrounded by a plastic case and the like for protecting the core from breakage.

In such a noise filter, core presser pieces are formed respectively in two divided cases in order to securely hold the ferrite core in the case. When the divided cases are coupled to each other, the core presser pieces nip the core to fix the position of the core. Such arrangement is disclosed in laid open Japanese Patent Application Publication No. 2001-326123.

SUMMARY OF THE INVENTION

However, in the conventional noise filter, the core in the case is supported in only one direction, so that application of an impact to the core from a different direction from the supporting direction may bring the core into direct contact with the case, resulting in breakage of the core due to failing to absorb the impact. If the core is cracked, a closed magnetic loop structure cannot be achieved. As a result, predetermined noise absorbing effect cannot be obtained. Further, if the noise filter is incorporated in electric components of a vehicle, cores that have been cracked due to vibration of the vehicle may clash with one another to make a whining sound in some cases.

It is therefore, an object of the present invention to provide an impact and vibration-resistant noise filter in which a crack of the core can be prevented against vibration or impact.

This, and other object of the present invention can be attained by a noise filter including a core, and a case. The case accommodates therein the core and includes a first case and a second case. The first case covers a half of an outer peripheral surface of the core in a direction perpendicular to the cable insertion direction. The second case is coupled to the first case and covers a remaining half of the outer peripheral surface of the core. The first case includes a first side peripheral portion, and a second side peripheral portion. The first side peripheral portion has a first end defining a first parting surface extending in a direction parallel to the cable insertion direction. The second side peripheral portion confronts the first side peripheral portion and has a second end defining a second parting surface extending in a direction parallel to the first parting surface. The first side peripheral portion has a first core support piece for biasing the core toward the second side peripheral portion. The second side peripheral portion has a second core support piece for biasing the core toward the first side peripheral portion. The second case includes a third side peripheral portion and a fourth side peripheral portion. The third side peripheral portion has a third end defining a third parting surface extending in a direction parallel to the cable insertion direction and configured to be in surface contact with the first parting surface. The fourth side peripheral portion confronts the third side peripheral portion and has a fourth end defining a fourth parting surface extending in a direction parallel to the third parting surface and configured to be in surface contact with the second parting surface. The third side peripheral portion has a third core support piece for biasing the core toward the fourth side peripheral portion. The fourth side peripheral portion has a fourth core support piece for biasing the core toward the third side peripheral portion.

DETAILED DESCRIPTION OF THE PREFERRED EMBODIMENTS

Figure 1:
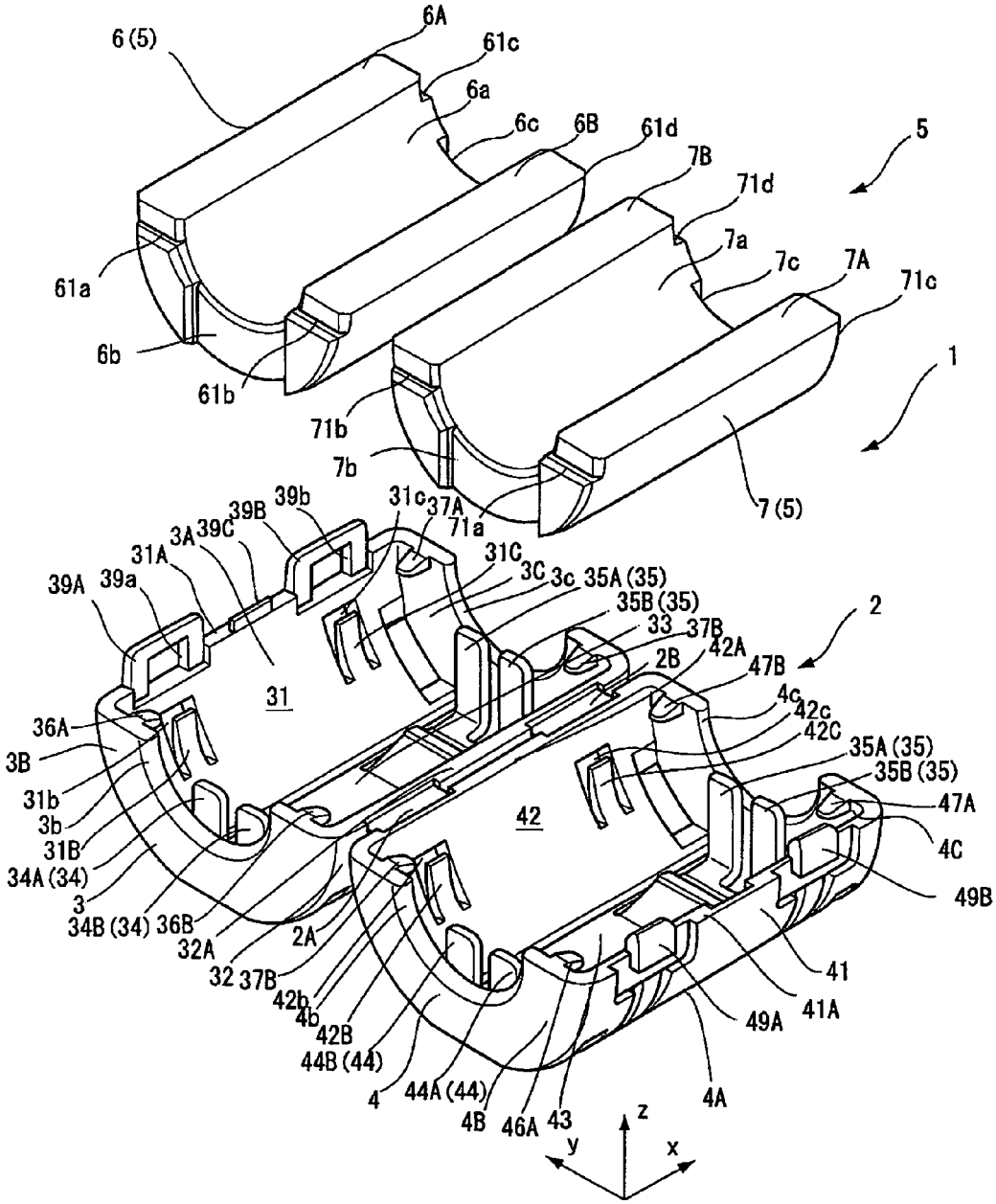
FIG. 1 is an exploded perspective view of a noise filter according to a first embodiment of the present invention.

A noise filter according to a first embodiment of the present invention will be described with reference to FIGS. 1 to 6. A noise filter 1 includes a case 2 and a core 5. As shown in FIG. 1, the case 2, which is made from an elastic resin material, is constituted by first and second case portions 3 and 4. Hinges 2A and 2B are provided between the first and second case portions 3 and 4 to integrate the first and second case portions 3 and 4.

Figure 2:
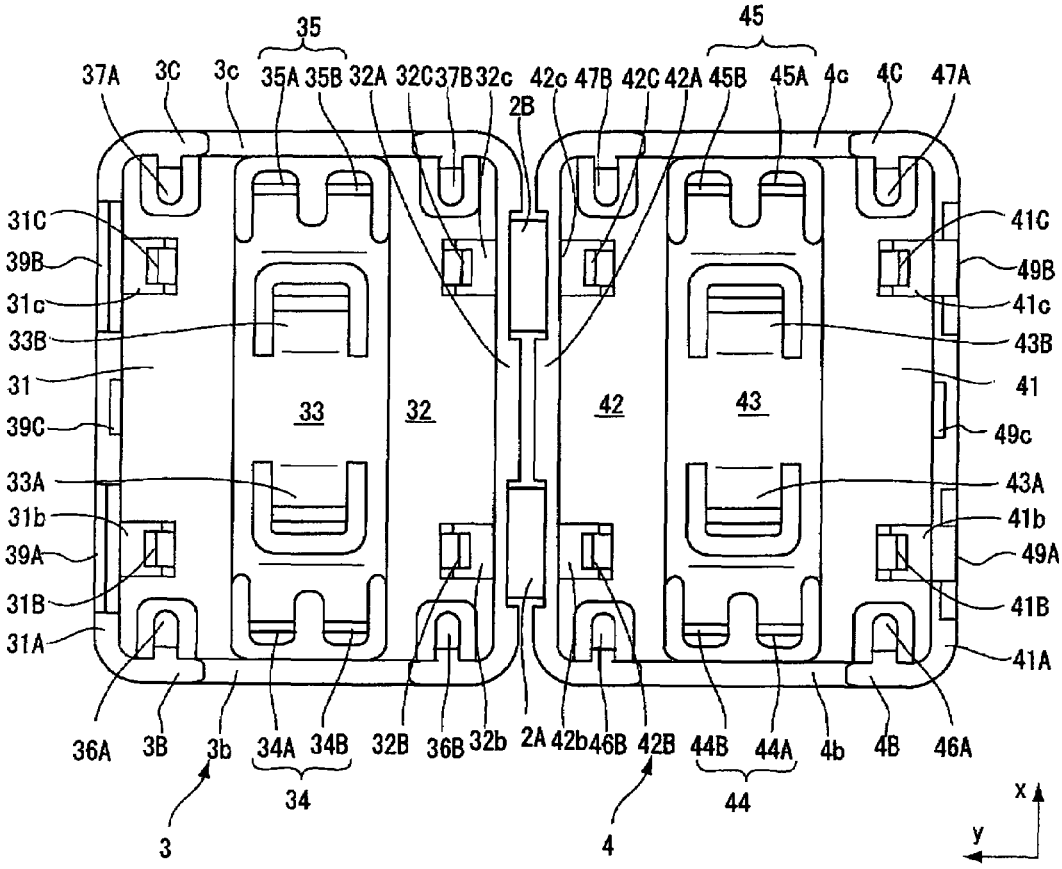
FIG. 2 is a plan view of the noise filter according to the first embodiment.

The first case portion 3 is constituted by a first peripheral wall portion 3A, a first end wall portion 3B extending from one end of the first peripheral wall portion 3A, and a second end wall portion 3C extending from another end of the first peripheral wall portion 3A. Hereinafter, direction from the one end toward the other end of the first peripheral wall portion 3A (i.e., cable insertion direction) is defined as x-axis direction. The first peripheral wall portion 3A includes a first wall portion 31, a second wall portion 32, and a first bottom wall portion 33 (FIG. 2). The first wall portion 31 has a first parting surface 31A extending substantially in the x-axis direction defined on the end surface of the first wall portion 31. The second wall portion 32 has a second parting surface 32A extending substantially in parallel to the first parting surface 31A and defined on the end surface of the second wall portion 32. The first bottom wall portion 33 connects the first and second wall portions 31 and 32. The first and second parting surfaces 32A and 32A are flush with each other.

The second parting surface 32A of the second wall portion 32 is connected integrally to one side ends of the hinges 2A and 2B. To the other side ends of the hinges 2A and 2B, the second case portion 4 is integrally connected. Hereinafter, direction from the first case portion 3 toward the second case portion 4 (i.e., direction perpendicular to x-axis direction) is defined as y-axis direction. Further, direction perpendicular to both x-axis and y-axis is defined as z-axis direction.

Each of the first and second end wall portions 3B and 3C is formed into a semi-circular shape. Semicircular arc-shaped first and second cable insertion grooves 3*b* and 3*c* are formed in center positions of the first and second end wall portions 3B and 3C in substantially y-axis direction.

Figure 3:
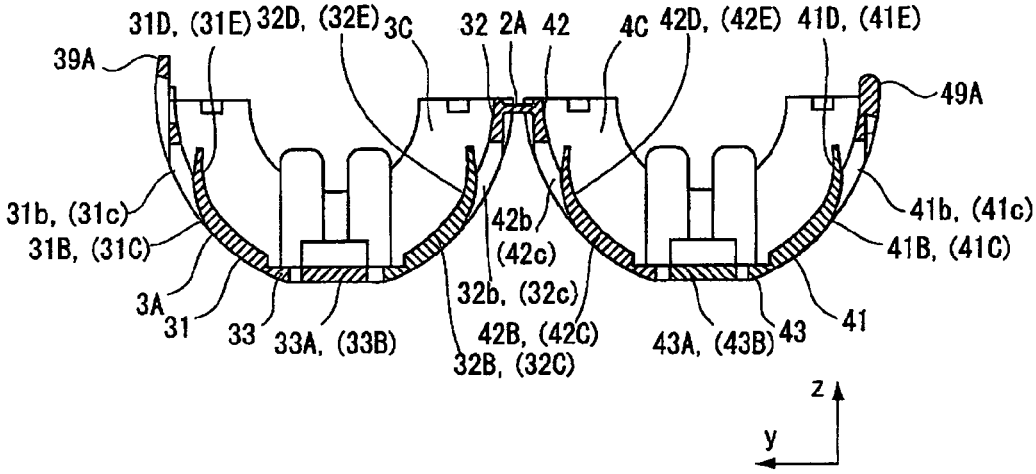
FIG. 3 is a cross-sectional view taken along the plane y-z for showing only a case of the noise filter according to the first embodiment.

As shown in FIG. 3, the first peripheral wall portion 3A including the first wall portion 31, first bottom wall portion 33, and second wall portion 32 has a y-z cross-section formed into a circular-arc shape extending along the circumferences of the first and second end wall portions 3B and 3C. As shown in FIGS. 1 and 2, square cut holes 31*b* and 31*c* are arrayed in x-axis direction on the first wall portion 31. In the square cut holes 31*b* and 31*c*, first supporting pieces 31B and 31C are provided. Each supporting piece 31B, 31C has a base end on the first bottom wall portion 33 side and a free end on the first parting surface 31A side. The free ends of the first supporting pieces 31B and 31C extend up to the position near the first parting surface 31A. As shown in FIG. 3, first contacting surfaces 31D and 31E are defined on the surfaces of the first supporting pieces 31B and 31C which are continuous from the inner surface of the first peripheral wall portion 3A. The first supporting pieces 31B and 31C are bent such that the free ends of the first supporting pieces 31B and 31C are positioned inward of the first peripheral wall portion 3A.

Similarly, as shown in FIG. 2, square cut holes 32*b* and 32*c* are arrayed in x-axis direction on the second wall portion 32. In the square cut holes 32*b* and 32*c*, second supporting pieces 32B and 32C are provided. Each second supporting piece 32B, 32C has a base end on the first bottom wall portion 33 side and a free end on the second parting surface 32A side. The free ends of the second supporting pieces 32B and 32C extend up to the position near the second parting surface 32A. As shown in FIG. 3, second contacting surfaces 32D and 32E are defined on the surfaces of the second supporting pieces 32B and 32C which is continuous from the inner surface of the first peripheral wall portion 3A. The second supporting pieces 32B and 32C are bent such that the free ends of the second supporting pieces 32B and 32C are positioned inward of the first peripheral wall portion 3A.

As shown in FIG. 2, first core presser pieces 33A and 33B are arrayed in x-axis direction at the center position on the first bottom wall portion 33. Each of the first core presser pieces 33A and 33B is formed by cutting a part of the first bottom wall portion 33 in substantially a U-like shape to obtain a cut piece and bending the cut piece inward the first peripheral wall portion 3A with a portion continuing from the first bottom wall portion 33 being as a base end.

First and second cable holding portions 34 and 35 are formed on the first peripheral wall portion 3A at the positions outside the first core presser pieces 33A and 33B in x-axis direction.

The first cable holding portion 34 is constituted by first and second arms 34A and 34B extending from the first bottom wall portion 33 in substantially parallel to z-axis direction at a position near the first end wall portion 3B. In this configuration, the first cable holding portion 34 can hold a cable (not shown) between the first and second arms 34A and 34B. Note that the first and second arms 34A and 34B are plane symmetric with respect to an imaginary z-x plane which passes the intermediate position between the first and second arms 34A and 34B.

The second cable holding portion 35 has the same configuration as that of the first cable holding portion 34 and is constituted by first and second arms 35A and 35B extending from the first bottom wall portion 33 in substantially parallel to z-axis direction at a position near the second end wall portion 3C.

A set of core holding members 36A and 36B extend, in parallel to x-axis direction, from the first end wall portion 3B toward the inside of the first case portion 3 at a position near the first parting surface 31A and second parting surface 32A, respectively. Similarly, another set of core holding members 37A and 37B extend, in parallel to x-axis direction, from the second end wall portion 3*c* toward the inside of the first case portion 3 at a position near the first parting surface 31A and second parting surface 32A, respectively.

First and second hook retaining pieces 39A and 39B extend in z-axis direction from the first parting surface 31A of the first wall portion 31. First and second hook retaining through holes 39*a* and 39*b* are formed in the first and second hook retaining pieces 39A and 39B, respectively. Further, a convex portion 39C protrudes from the first parting surface 31A at substantially intermediate portion between the first and second hook retaining pieces 39A and 39B.

The second case portion 4 is constituted by a second peripheral wall portion 4A, a third end wall portion 4B extending from one end of the second peripheral wall portion 4A, and a fourth end wall portion 4C extending from another end of the second peripheral wall portion 4A. That is, the second case portion 4 has substantially a symmetric configuration to that of the first case portion 3 with respect to z-x plane which passes y-axis direction at an intermediate position between the hinges 2A and 2B. Thus, among the components of the second case portion 4, a third wall portion 41, a fourth wall portion 42, a second bottom wall portion 43, a third cable insertion groove 4*b*, a fourth cable insertion groove 4*c*, square cut holes 41*b* and 41*c*, third supporting pieces 41B and 41C, third contacting surfaces 41D and 41E, square cut holes 42*b* and 42*c*, fourth supporting pieces 42B and 42C, fourth contacting surfaces 42D and 42E, second core presser pieces 43A and 43B, a third cable holding portion 44, a fourth cable holding portion 45, a set of core holding members 46A and 46B, and another set of core holding members 47A and 47A, have the same configurations as those of the first case portion 3, and descriptions of the above components will be omitted.

As shown in FIG. 1, first and second hook retaining claws 49A and 49B engageable with the first and second hook retaining through holes 39*a* and 39*b* are formed on the third parting surface 41A of the third wall portion 42. Further, a concave portion 49*c* into which the convex portion 39C is insertable is formed on the third parting surface 41A at the position substantially intermediate between the first and second hook retaining claws 49A and 49B.

As shown in FIG. 1, the core 5 is constituted by first and second cores 6 and 7 each having a hollow semi-cylindrical shape and made from ferrite base material. The first core 6 has first and second planar surfaces 6A and 6B which are cut surfaces obtained when the ferrite base material is divided into halves. Between the first and second planar surfaces 6A and 6B, a first core groove 6*a* which is the half part of a through-hole through which a cable (not shown) passes is formed. This first core groove 6*a* and a second core groove 7*a* (to be described later) constitute a cable insertion path when first and second cores 6 and 7 are fitted to each other. First and second engagement recesses 61*a* and 61*b* engageable with the first core holding members 36A and 36B are formed on one end of the first and second planar surfaces 6A and 6B. Similarly, third and fourth engagement recesses 61*c* and 61*d* engageable with the first core holding members 37A and 37B are formed on another end of the first and second planar surfaces 6A and 6B. Further, first and second concave portions 6*b* and 6*c* are formed at one end and another end of the bottom portion of the first core groove 6*a* of the first core 6. The first and second concave portions 6*b* and 6*c* serve as spaces into which the first and second cable holding portions 34 and 35 are inserted when the first core 6 is attached to the first case portion 3.

The second core 7 has a configuration the same as that of the first core 6. That is, the second core 7 has first and second planar surfaces 7A and 7B, a second core groove 7*a*, first and second engagement recesses 71*a* and 71*b* engageable with the second core holding members 46A and 46B formed on one end of the first and second planar surfaces 7A and 7B, third and fourth engagement recesses 71*c* and 71*d* engageable with the second core holding members 47A and 47B formed on another end of the first and second planar surfaces 7A and 7B, and third and fourth concave portions 7*b* and 7*c* formed at one end and another end of the bottom portion of the second core groove 7*a*.

Figure 4:
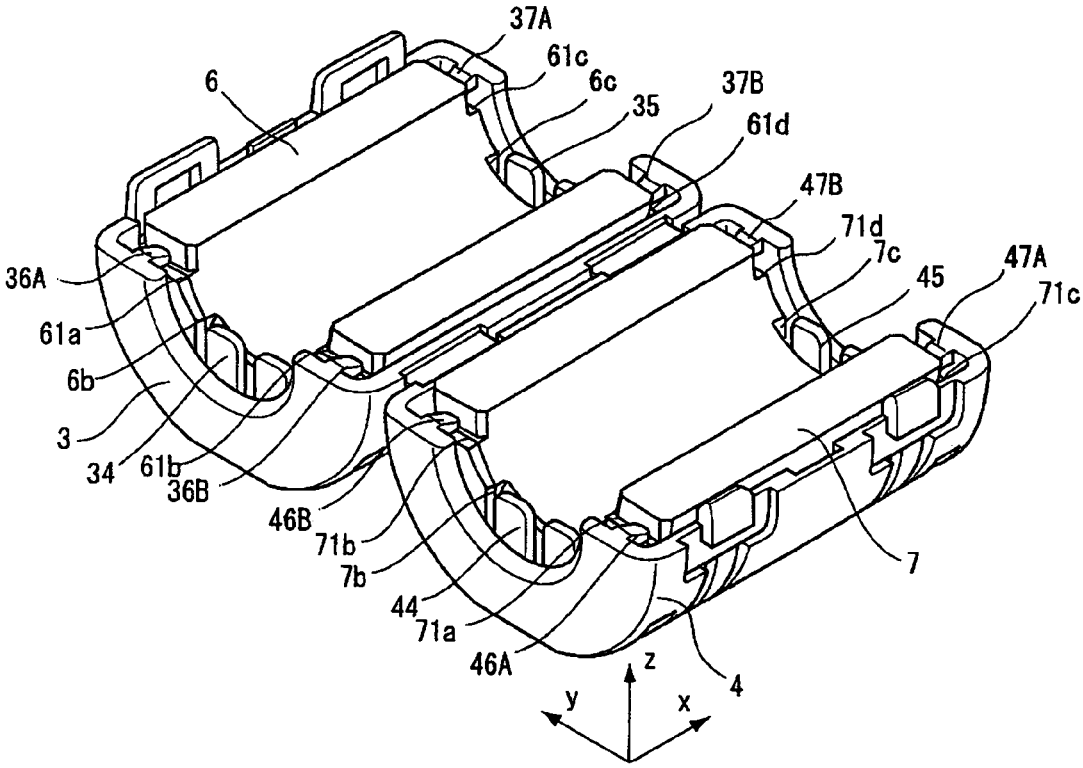
FIG. 4 is a perspective view showing a state in which the case and core of the noise filter according to the first embodiment have been combined with each other.

FIG. 4 shows a state in which the first and second cores 6 and 7 have been attached to the case 2. Specifically, when the first core 6 is inserted into the first case portion 3, the first and second cable holding portions 34 and 35 are inserted into the first and second concave portions 6*b* and 6*c* and, at the same time, the first core holding members 36A, 36B and second core holding members 37A, 37B are engaged with the first to forth engagement recesses 61*a* to 61*d*. In this state, as shown in FIG. 5, the first and second planar surfaces 6A, 6B are positioned higher than the level of the first and second parting surfaces 31A and 32A.

Figure 5:
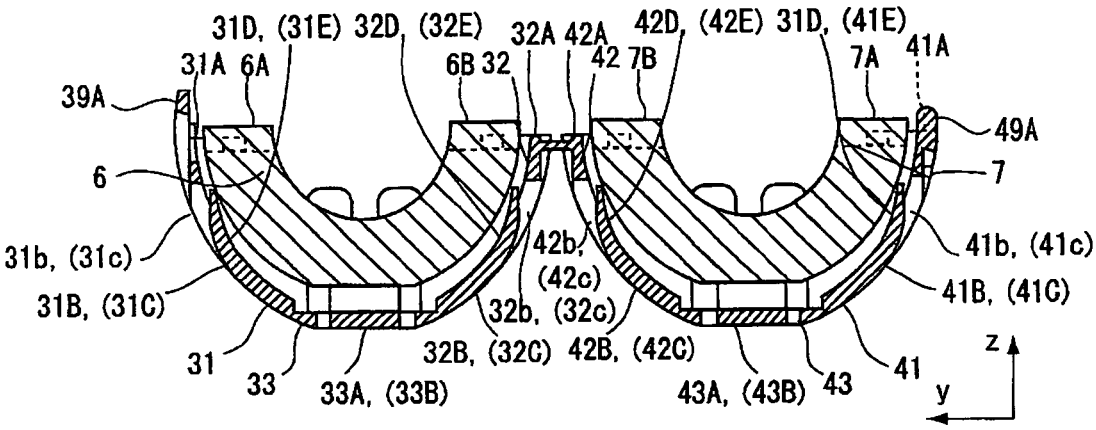
FIG. 5 is a cross-sectional view taken along the y-z plane for showing a state in which the case and core of the noise filter according to the first embodiment are combined with each other.

Further, in this state, the first core 6 is biased by the first core presser pieces 33A and 33B in z-axis direction, as shown in FIG. 5. Therefore, the first core 6 is retained at least in z-axis direction by the first core presser pieces 33A, 33B, first core holding members 36A, 36B, and second core holding members 37A, 37B (FIG. 2).

Further, as shown in FIG. 5, the first core 6 is biased by the first supporting pieces 31B, 31C and second supporting pieces 32B, 32C. Since the free ends of the first supporting pieces 31B, 31C and second supporting pieces 32B, 32C are positioned respectively near the first and second parting surfaces 31A and 32A, the biasing forces of the first supporting pieces 31B, 31C and second supporting pieces 32B, 32C are at least directed toward the second wall portion 32 and first wall portion 31, respectively. Therefore, the first core 6 is resiliently retained in y-axis direction. Further, when the first core 6 is retained by first supporting pieces 31B, 31C and second supporting pieces 32B, 32C, the first contacting surfaces 31D, 31E and second contacting surfaces 32D, 32E are in surface contact with the first core 6. As a result, the first core 6 is stably retained by the respective supporting pieces. Similarly, the second core 7 is retained in the second case portion 4.

Figure 6:
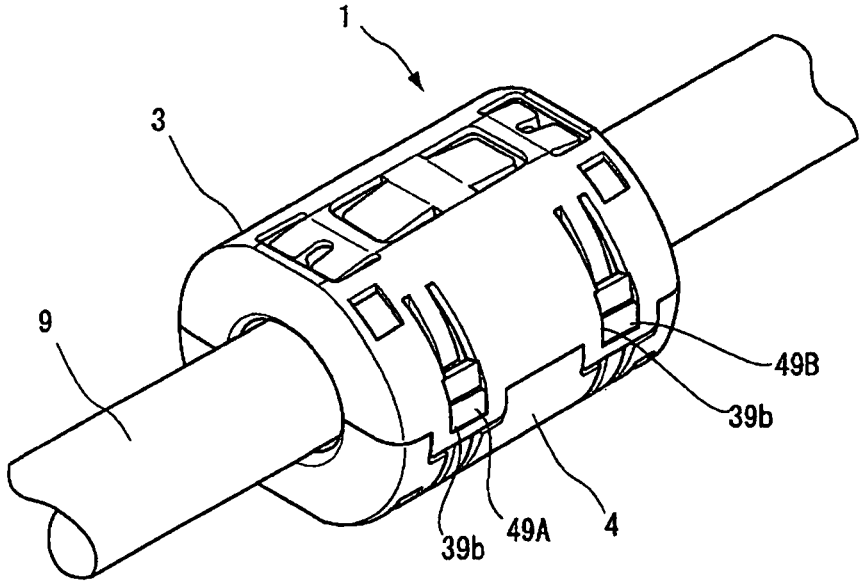
FIG. 6 is a perspective view showing a state in which the noise filter according to the first embodiment has been attached to a cable.

For disposing the noise filter 1 over a cable 9 as shown in FIG. 6, the cable 9 is disposed in the first core groove 6*a* (FIG. 2). The second case portion 4 is then pivoted to the first case portion 3 about the hinges 2A and 2B (FIG. 2). Then, the first and second hook retaining claws 49A and 49B are brought into engagement with the first and second hook retaining through holes 39*a* and 39*b*. At the same time, the convex portion 39C is inserted into the concave portion 49*c* to close the case 2. In this sate, the first and second planar surfaces 6A, 6B of the first core 6 (FIG. 1) and the first and second planar surfaces 7A and 7B of the second core 7 (FIG. 1) are brought into contact with each other. At this time, the first core 6 is moved in the opposite direction to the biasing direction of the first core presser pieces 33A and 33B, resulting in release of the engagement between the first core 6 and first to fourth engagement recesses 61*a* to 61*d*. Similarly, the second core 7 is moved in the opposite direction to the biasing direction of the second core presser pieces 43A and 43B, resulting in release of the engagement between the second core 7 and first to fourth engagement recesses 71*a* to 71*d*. In this state, the core 5 including the first and second cores 6 and 7 is resiliently retained in the case 2 by the first core presser pieces 33A, 33B and second core presser pieces 43A, 43B in z-axis direction.

As described above, the first and second cores 6 and 7 are resiliently retained in y-axis direction. Therefore, in a state in which the noise filter 1 has been attached to the cable 9 as shown in FIG. 6, the core 5 is resiliently retained in the case 2 in the direction perpendicular to x-axis direction (i.e., direction perpendicular to the cable insertion direction). Thus, even if an impact is applied to the noise filter 1 in y-axis or z-axis direction, the impact can be absorbed to thereby avoid breakage of the core 5.

Next, a noise filter according to a second embodiment of the present invention will be described with reference to FIGS. 7 through 9. A noise filter 101 shown in FIG. 7 has a configuration the same as that of the noise filter 1 according to the first embodiment except for the configuration of a first wall portion 131, a second wall portion 132, a third wall portion 141, and a fourth wall portion 142. Therefore, 100 are added to each of reference numbers of the components shown in FIGS. 1 to 6 and descriptions of the same components will be omitted.

Figure 7:
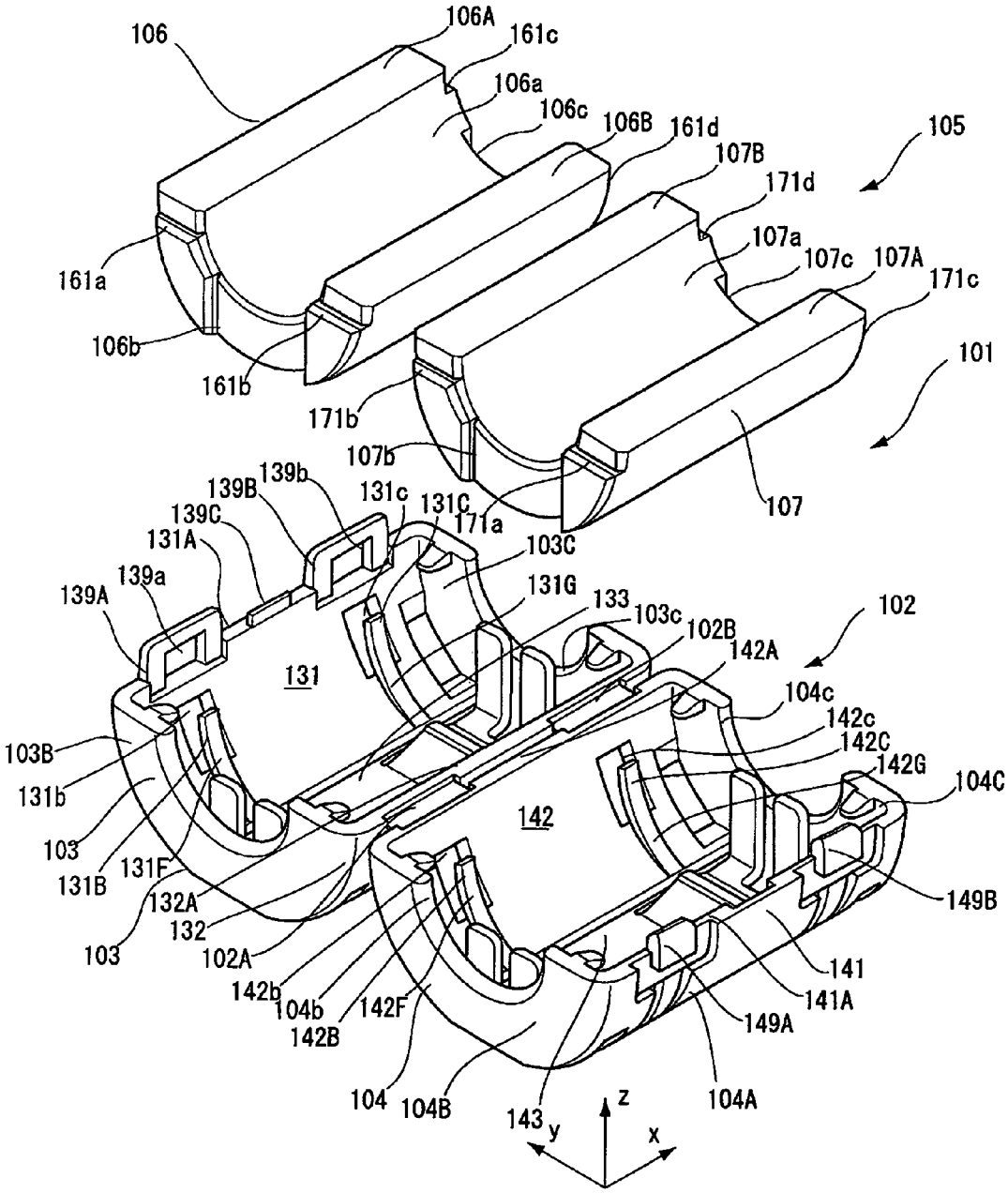
FIG. 7 is an exploded perspective view of a noise filter according to a second embodiment of the present invention.

As shown in FIG. 7, in a first case portion 103, first ribs 131F and 131G are formed on the first wall portion 131. The first ribs 131F and 131G extend, along the inner surface of the first wall portion 131, from the boundary between the first wall portion 131 and a first bottom wall portion 133 toward a first parting surface 131A. Further, second ribs 132F and 132G (FIG. 8) are formed in the second wall portion 132. Similarly, third ribs 141F and 141G (FIG. 7), and fourth ribs 142F and 142G are formed in a second case portion 4. In the first case portion 103, first supporting pieces 131B and 131C extend from the end portion of the first rib 131F, 131G, and similarly, second supporting pieces 132B and 132C extend from the end portion of the second rib 132F, 132G. The inner surfaces of the first ribs 131F, 131G and second ribs 132F, 132G are formed into an arcuate shape so as to follow the curvature of the outer peripheral surface of the first core 106.

Figure 8:
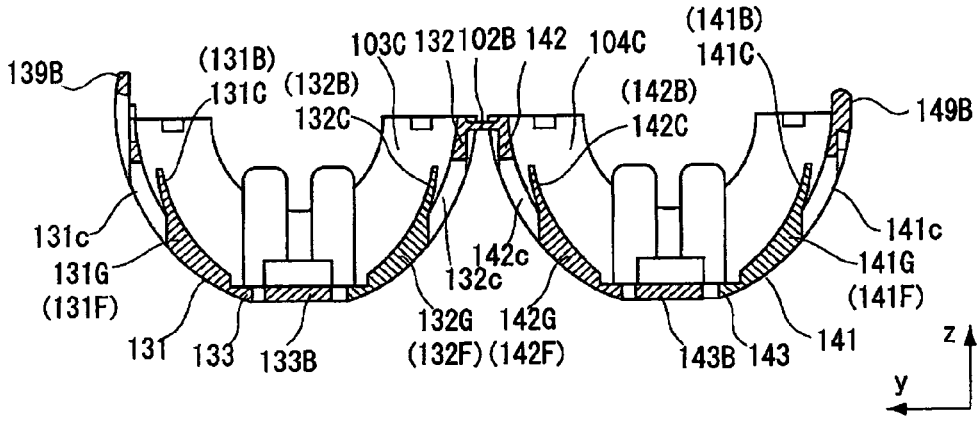
FIG. 8 is a cross-sectional view taken along the y-z plane showing only a case of the noise filter according to the second embodiment.

As shown in FIG. 8, the first supporting pieces 131B and 131C are bent from their base ends toward inward of the first case portion 103, and similarly, the second supporting pieces 132B and 132C are bent from their base ends toward inward of the first case portion 103.

Figure 9:
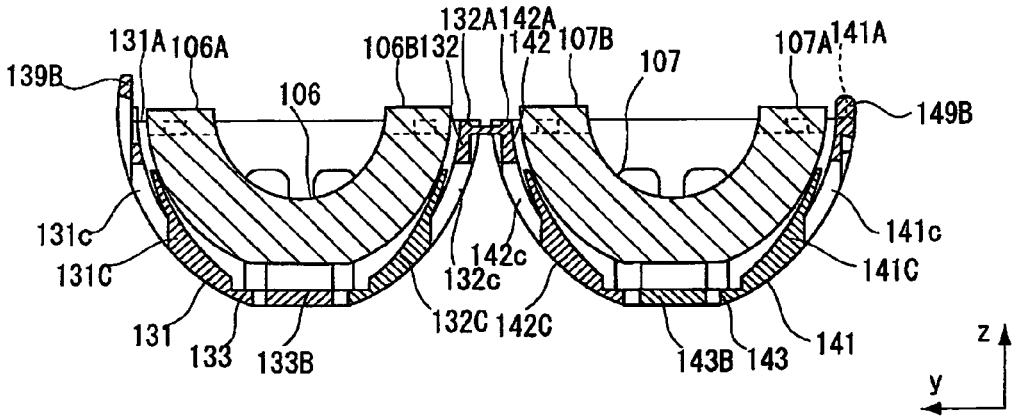
FIG. 9 is a cross-sectional view taken along the y-z plane for showing a state in which the case and core of the noise filter according to the second embodiment have been combined with each other.

Thus, as shown in FIG. 9, in a state in which the first core 106 has been inserted into the first case portion 103, the first core 106 is resiliently retained in y-axis direction by the first supporting pieces 131B, 131C and second supporting pieces 132B, 132C. Similarly, in the second case portion 104, the second core 107 is resiliently retained by the third supporting pieces 141B, 141C and fourth supporting pieces 142B, 142C. Therefore, as in the case of the noise filter according to the first embodiment, even if an impact is applied to the noise filter 101 in y-axis or z-axis direction, the impact can be absorbed to thereby prevent breakage of the core 105. Even if the shape of the inner surface contour of the case 102 differs from the contour of the outer surface of the core 105, the core 105 can be brought into contact with any of the first to fourth ribs 131F to 142G thus formed, preventing excessive displacement.

While the invention has been described in detail and with reference to specific embodiments thereof, it would be apparent to those skilled in the art that various changes and modifications can be made therein without departing from the scope of the invention. For example, an integrally-formed one piece tubular core can be used instead of the core of divided halves. Further, in the above-described embodiments, the case portions are integrally connected to each other by hinges. However, hooks or pawls can be used to connect the separate halves to each other.

What is claimed is:

1. A noise filter comprising:

a core defining therein a cable insertion hole extending in a cable insertion direction; and a case accommodating therein the core and comprising a first case covering a half of an outer peripheral surface of the core in a direction perpendicular to the cable insertion direction, and a second case coupled to the first case and covering a remaining half of the outer peripheral surface of the core; and wherein the first case comprises:

a first side peripheral portion having a first end defining a first parting surface extending in a direction parallel to the cable insertion direction;

a second side peripheral portion confronting the first side peripheral portion and having a second end defining a second parting surface extending in a direction parallel to the first parting surface, the first side peripheral portion having a first core support piece for biasing the core toward the second side peripheral portion, and the second side peripheral portion having a second core support piece for biasing the core toward the first side peripheral portion; and a first bottom wall portion connected to the first side peripheral portion and to the second side peripheral portion, the first bottom wall having a first core presser piece for biasing the core toward the second case; and wherein the second case comprises:

a third side peripheral portion having a third end defining a third parting surface extending in a direction parallel to the cable insertion direction and configured to be in surface contact with the first parting surface;

a fourth side peripheral portion confronting the third side peripheral portion and having a fourth end defining a fourth parting surface extending in a direction parallel to the third parting surface and configured to be in surface contact with the second parting surface, the third side peripheral portion having a third core support piece for biasing the core toward the fourth side peripheral portion, and the fourth side peripheral portion having a fourth core support piece for biasing the core toward the third side peripheral portion; and a second bottom wall portion connected to the third side peripheral portion and to the fourth side peripheral portion, the second bottom wall having a second core presser piece for biasing the core toward the first case.

2. The noise filter as claimed in claim 1, wherein the first case is made from a resilient material, and the first core support piece and the second core support piece are integral with the first side peripheral portion and the second side peripheral portion, and wherein the second case is made from a resilient material, and the third core support piece and the fourth core support piece are integral with the third side peripheral portion and the fourth side peripheral portion.

3. The noise filter as claimed in claim 1, wherein the first core support piece has a first contact surface in surface contact with the core; and wherein the second core support piece has a second contact surface in surface contact with the core; and wherein the third core support piece has a third contact surface in surface contact with the core; and wherein the fourth core support piece has a fourth contact surface in surface contact with the core.

4. The noise filter as claimed in claim 1 wherein the first core support piece has a base portion protruding from the first side peripheral wall portion at a position close to the first bottom wall portion, and a free end portion positioned close to the first parting surface and directed away from the first side peripheral wall portion; and wherein the second core support piece has a base portion protruding from the second side peripheral wall portion at a position close to the first bottom wall, and a free end portion positioned close to the second parting surface and directed away from the second side peripheral wall portion; and wherein the third core support piece has a base portion protruding from the third side peripheral wall portion at a position close to the second bottom wall, and a free end portion positioned close to the third parting surface and directed away from the third side peripheral wall portion; and wherein the fourth core support piece has a base portion protruding from the fourth side peripheral wall portion at a position close to the second bottom wall, and a free end portion positioned close to the fourth parting surface and directed away from the fourth side peripheral wall portion.

5. The noise filter as claimed in claim 4, wherein the first case further comprises a first rib protruding inward from the first side peripheral wall portion, the first core support piece protruding from the first rib and oriented toward the second side peripheral wall portion; and a second rib protruding inward from the second side peripheral wall portion, the second core support piece protruding from the second rib and oriented toward the first side peripheral wall portion; and wherein the second case further comprises a third rib protruding inward from the third side peripheral wall portion, the third core support piece protruding from the third rib and oriented toward the fourth side peripheral wall portion; and a fourth rib protruding inward from the fourth side peripheral wall portion, the fourth core support piece protruding from the fourth rib and oriented toward the third side peripheral wall portion.

6. The noise filter as claimed in claim 1, wherein the first case further comprises a first pair of end wall portions each formed with a cable insertion recess for providing the cable insertion hole, each end wall having a first pair of core holding member extending in the cable insertion direction and engageable with the core; and wherein the second case further comprises a second pair of end wall portions each formed with a cable insertion recess for providing the cable insertion hole, each end wall having a second pair of core holding member extending in the cable insertion direction and engageable with the core.

7. The noise filter as claimed in claim 6, wherein the first case further comprises a first pair of cable holding portions extending from the first bottom wall portion, each of the first pair of cable holding portions being positioned close to each of the first pair of end wall portions for holding the cable, and wherein the second case further comprises a second pair of cable holding portions extending from the second bottom wall portion, each of the second pair of cable holding portions being positioned close to each of the second pair of end wall portions for holding the cable.

8. The noise filter as claimed in claim 1, wherein the first case further comprises a first retaining piece and a second retaining piece those protruding from the first parting surface, and wherein the second case further comprises a first hook and a second hook engageable with the first retaining piece and second retaining piece, respectively, and the noise filter further comprising a hinge bridging between the second parting surface and the fourth parting surface.

9. The noise filter as claimed in claim 8, wherein the first case further comprises a convex portion protruding from the first parting surface, the third parting surface being formed with a concave portion engageable with the convex portion when the first hook and the second hook are engaged with the first retaining piece and the second retaining piece.

10. A noise filter comprising:

a core defining therein a cable insertion hole extending in a cable insertion direction; and a case accommodating therein the core and comprising a first case covering a half of an outer peripheral surface of the core in a direction perpendicular to the cable insertion direction, and a second case coupled to the first case and covering a remaining half of the outer peripheral surface of the core; and wherein the first case comprises:

a first side peripheral portion having a first end defining a first parting surface extending in a direction parallel to the cable insertion direction; and a second side peripheral portion confronting the first side peripheral portion and having a second end defining a second parting surface extending in a direction parallel to the first parting surface, the first side peripheral portion having a first core support piece for biasing the core toward the second side peripheral portion, and the second side peripheral portion having a second core support piece for biasing the core toward the first side peripheral portion; and, wherein the second case comprises:

a third side peripheral portion having a third end defining a third parting surface extending in a direction parallel to the cable insertion direction and configured to be in surface contact with the first parting surface; and a fourth side peripheral portion confronting the third side peripheral portion and having a fourth end defining a fourth parting surface extending in a direction parallel to the third parting surface and configured to be in surface contact with the second parting surface, the third side peripheral portion having a third core support piece for biasing the core toward the fourth side peripheral portion, and the fourth side peripheral portion having a fourth core support piece for biasing the core toward the third side peripheral portion; wherein:

the first case further comprises a first retaining piece and a second retaining piece protruding from the first parting surface, the second case further comprises a first hook and a second hook engageable with the first retaining piece and the second retaining piece, respectively, the noise filter further comprising a hinge bridging between the second parting surface and the fourth parting surface, and the first case further comprises a convex portion protruding from the first parting surface, the third parting surface being formed with a concave portion engageable with the convex portion when the first hook and the second hook are engaged with the first retaining piece and the second retaining piece.

* * * * *